US006639494B1

(12) United States Patent
Bluzer

(10) Patent No.: US 6,639,494 B1
(45) Date of Patent: Oct. 28, 2003

(54) MICROELECTROMECHANICAL RF SWITCH

(75) Inventor: Nathan Bluzer, Rockville, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 10/321,562

(22) Filed: Dec. 18, 2002

(51) Int. Cl.[7] ..... H01H 57/00
(52) U.S. Cl. ..... 335/78; 335/4; 200/181
(58) Field of Search ..... 335/78–86, 4; 200/181; 257/411, 414, 421, 531, 600

(56) References Cited

U.S. PATENT DOCUMENTS 6,384,353 B1 * 5/2002 Huang et al. ..... 200/181

* cited by examiner

*Primary Examiner*—Ramon M. Barrera
(74) *Attorney, Agent, or Firm*—Birch, Stewart, Kolasch & Birch, LLP

(57) ABSTRACT

A MEMS switch with a bridge having three symmetric arms each having one end connected to a support arrangement and another end integral with a common central bridge portion. First and second conductors are deposited on a substrate, with the first conductor having an end with an open area which encompasses a pull down electrode which is also on the substrate, and of a height less than that of the conductor. A control voltage applied to the pull down electrode causes downward movement of the bridge, to present a relatively low impedance, thereby allowing a signal to propagate between the first and second conductors, without the bridge touching the pull down electrode. Each of the arms is slotted to reduce curl-induced stiffness.

11 Claims, 3 Drawing Sheets

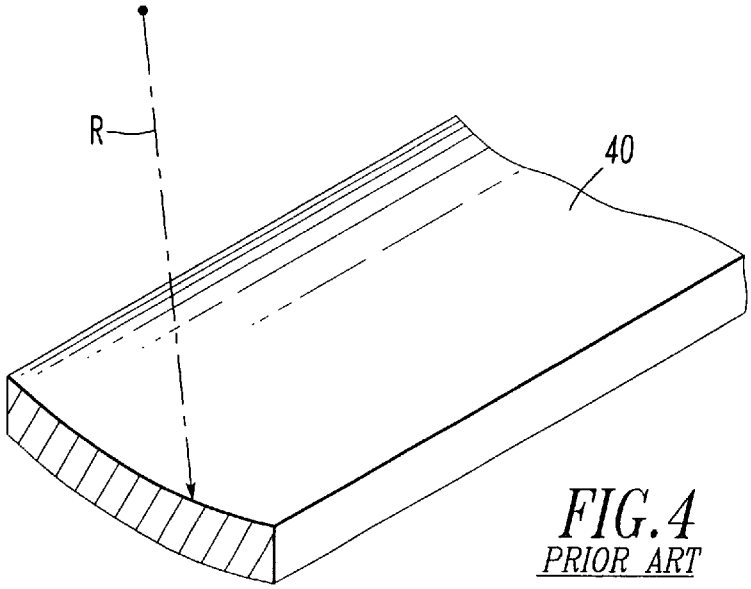
FIG. 4
PRIOR ART
FIG. 5
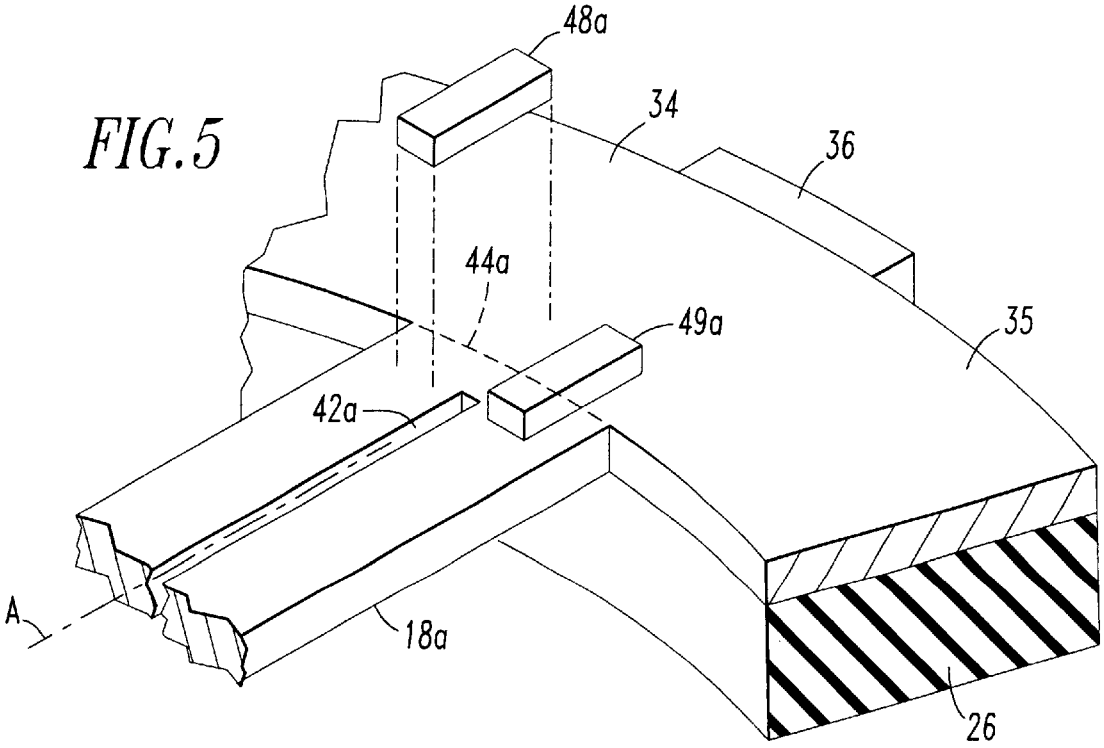

MICROELECTROMECHANICAL RF SWITCH

CROSS-REFERENCE TO RELATED APPLICATIONS

The present invention is related in subject matter to patent application Ser. No. 10/157,935, filed May 31, 2002, and to patent application Ser. No. 10/322,728, filed Dec. 19, 2002 {NGC case 000251-078}, filed concurrently herewith, all of which are assigned to the same assignee as the present invention.

BACKGROUND OF THE INVENTION

1. Field of the Invention

The invention in general relates to miniature switches, and more particularly, to a MEMS switch useful in radar and other microwave applications.

2. Description of Related Art

A variety of MEMS (microelectromechanical systems) switches are in use, or proposed for use, in radar and communication systems, as well as other high frequency circuits for controlling RF signals. These MEMS switches are popular insofar as they can have a relatively high off impedance, with a low off capacitance, and a relatively low on impedance, with a high on capacitance, leading to desirable high cutoff frequencies and wide bandwidth operation. Additionally, the MEMS switches have a small footprint, can operate at high RF voltages and are compatible with conventional integrated circuit fabrication techniques.

Many of these MEMS switches generally have electrostatic elements, such as opposed electrodes, which are attracted to one another upon application of a DC pull down control voltage. At least one of these DC pull down electrodes is on a substrate and an opposing electrode is defined on the underside of a moveable bridge above the substrate. Upon application of the DC pull down control voltage, the bridge is deflected down and the electrical impedance is severely reduced (either by capacitive coupling or by direct ohmic contact), between first and second spaced apart RF conductors on the substrate.

In some MEMS switches the particular bridge design creates asymmetric transverse and longitudinal vibration modes during operation. Switching between on and off states moves the bridge and excites vibration modes, which can lead to undesirable electrical impedance modulation. This impedance modulation is further increased with bridge designs that are laterally asymmetric, causing twisting modes to occur.

In addition, the bridge may be fabricated from different layers. Internal stresses in the bridge's arms can cause the bridge arms to curl and thereby stiffen. This stiffening due to stress-induced curling can increase the pull down voltage requirement by more than 100%. This is undesirable from an integrated circuit operating point of view.

In conventional capacitive type MEMS switches the portion of the conductor below the bridge is covered with a dielectric layer. Repeated application of the DC pull down voltage between the bridge and pull down conductor causes a charge build up in the dielectric. This charge build up in the dielectric may cause the bridge to stick and remain attracted to the conductor in an on condition, even after removal of the pull down voltage.

It is an object of the present invention to provide a MEMS switch which reduces or eliminates the undesired asymmetric transverse and longitudinal vibration modes in the bridge structure.

It is a further object to eliminate the sticking problem in a capacitive type MEMS switch produced by charge built up in the dielectric.

SUMMARY OF THE INVENTION

A MEMS switch is provided which includes a substrate member with first and second spaced-apart RF conductors deposited on the substrate. A bridge member having at least three radially disposed arms of equal length is connected to a support arrangement on the substrate, with each arm having one end connected to the support arrangement and a second end integral with a common central bridge portion having an undersurface. At least one of the arms is electrically connected to the second conductor. The first conductor has an end portion facing the undersurface of the central bridge portion, with the end portion of the first conductor being constructed and arranged to define an open area. A pull down electrode is disposed within the open area of the first conductor and is electrically isolated from the conductor. The height of the pull down electrode is less than that of the end portion. The central bridge portion is drawn toward the first conductor upon application of a control voltage to the pull down electrode, to vary the electrical impedance between the first and second conductors. The impedance is varied from a high value (off state) to a low value (on state) relative to the impedance of the conductors, thus allowing a signal to propagate between the first and second conductors.

Further scope of applicability of the present invention will become apparent from the detailed description provided hereinafter. It should be understood, however, that the detailed description and specific example, while disclosing the preferred embodiment of the invention, is provided by way of illustration only, since various changes and modifications within the spirit and scope of the invention will become apparent to those skilled in the art, from the detailed description.

BRIEF DESCRIPTION OF THE DRAWINGS

The present invention will become more fully understood from the detailed description provided hereinafter and the accompanying drawings, which are not necessarily to scale, and are given by way of illustration only. In addition, the use of spatial terms such as top, bottom, above, below etc. is for ease of explanation and not as structural or orientation limitations.

FIG. 4 is a partial view of an arm of a prior art MEMS switch.

FIG. 5 is a partial view of one of the arms of the bridge of the switch of FIG. 1.

DESCRIPTION OF THE PREFERRED EMBODIMENT

Figure 1:
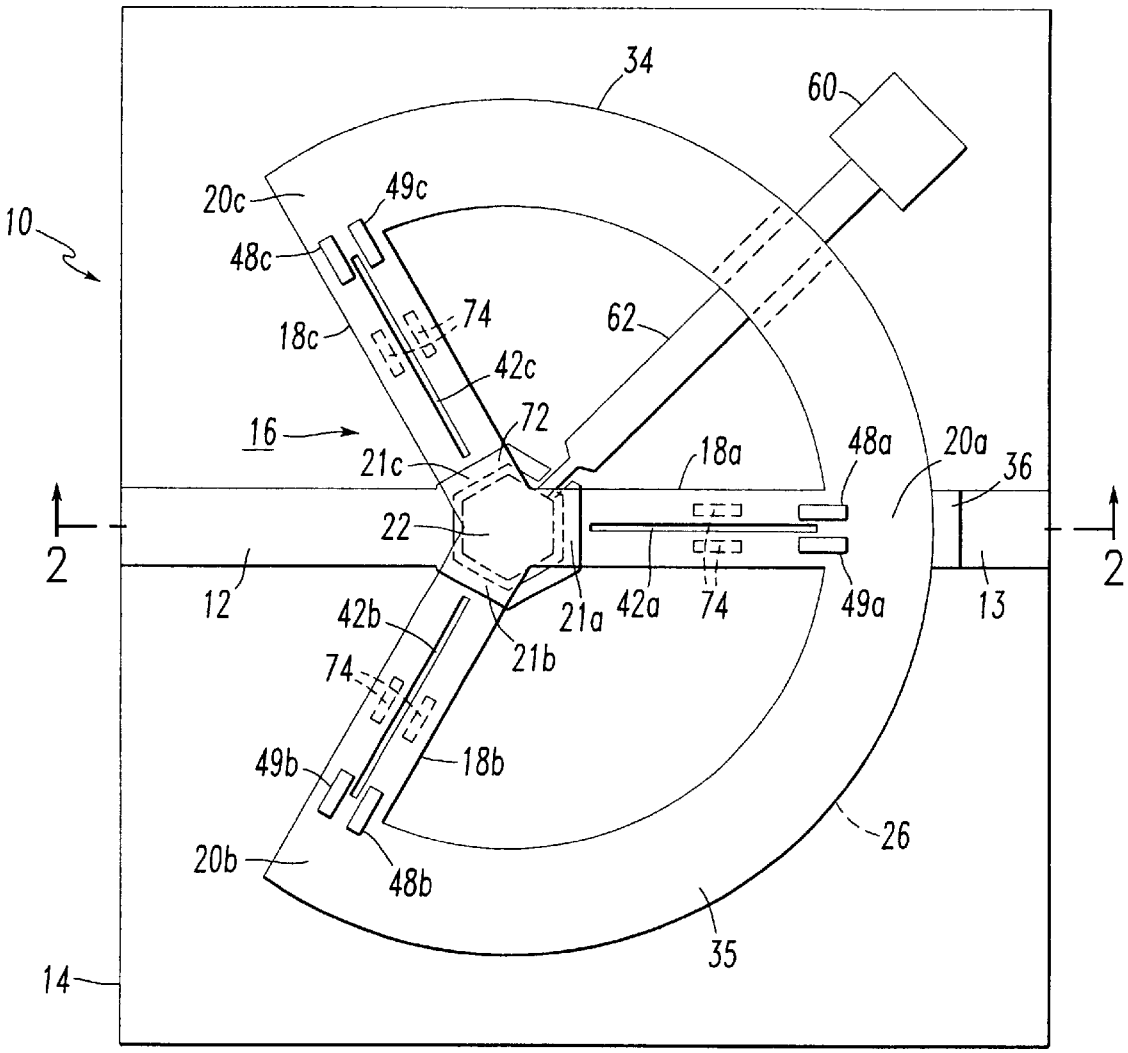
FIG. 1 is a plan view of a MEMS switch in accordance with one embodiment of the present invention.
Figure 2:
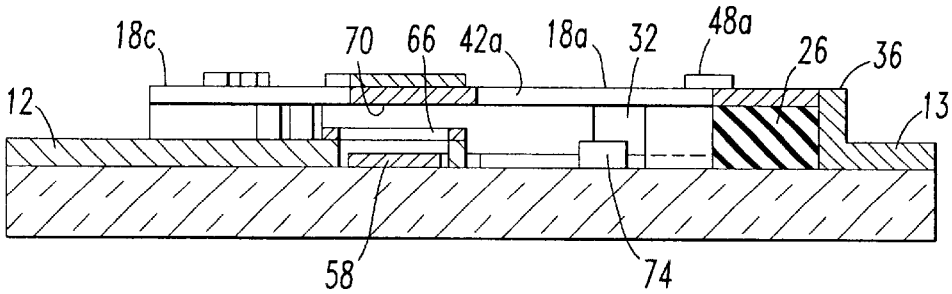
FIG. 2 is a view along line 2—2 of FIG. 1.
Figure 3:
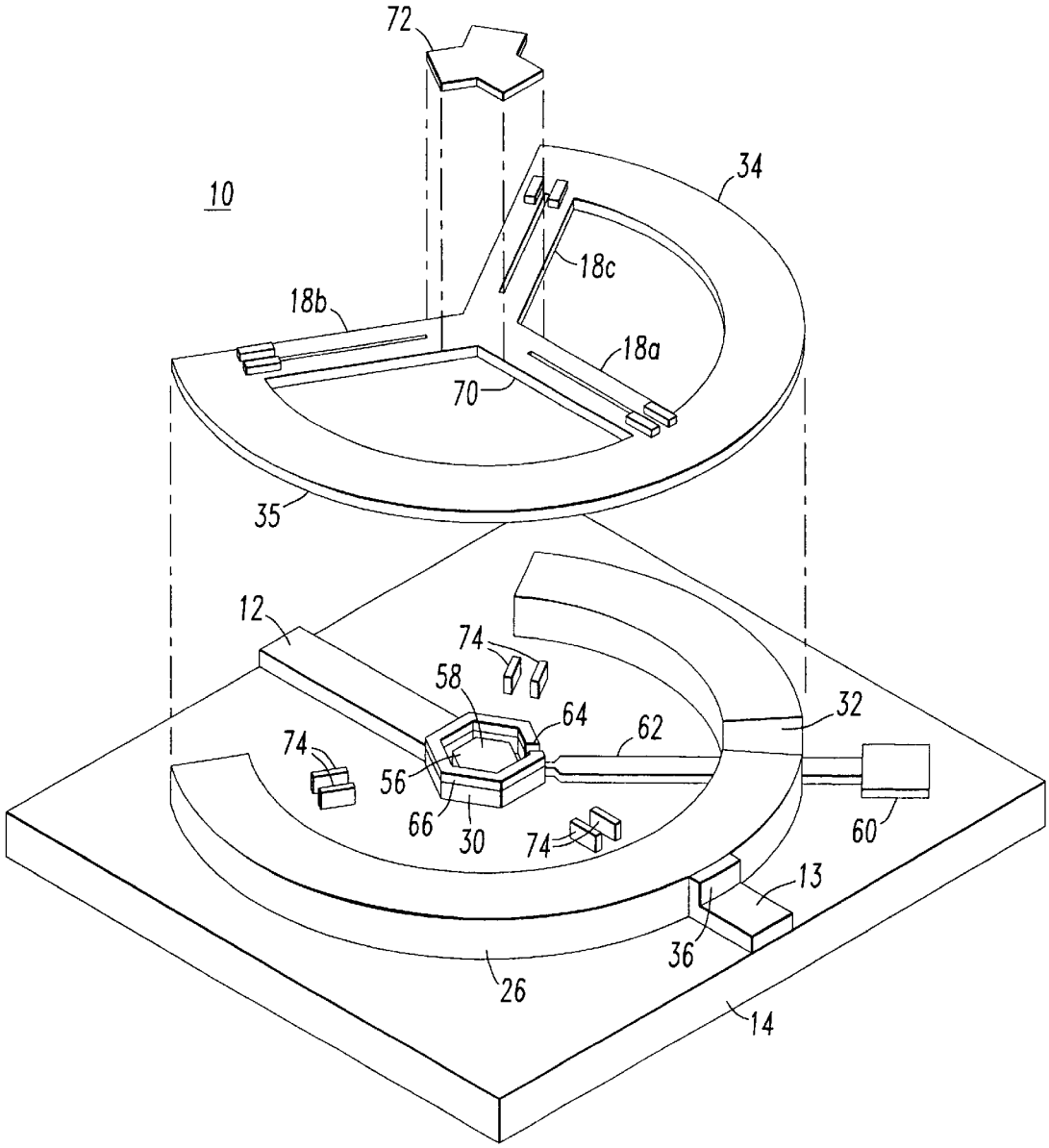
FIG. 3 is an isometric exploded view of the switch of FIG. 1.

Referring now to FIGS. 1 to 3, the improved MEMS switch 10 includes first and second spaced apart RF conductors 12 and 13, typically 50 ohm microstrips for carrying and propagating microwave signals, and deposited on a substrate 14 (generally over an oxide or other insulator). Typical substrates include gallium arsenide, silicon, alumina or sapphire, by way of example.

Switch 10 includes a bridge member 16 having at least three radially symmetrically disposed arms 18*a,* 18*b,* and 18*c* of equal length. For a three arm embodiment as illustrated, the arms would be 120° apart. Each arm includes a respective first, or distal end, 20*a,* 20*b,* and 20*c,* as well as a respective second, or proximate end, 21*a,* 21*b* and 21*c,* with these second ends being integral with a common central bridge portion 22. This bridge design reduces twisting and radially asymmetrical vibration modes.

As best seen in FIG. 3, each of the first ends 20*a,* 20*b,* and 20*c* of arms 18*a,* 18*b,* and 18*c* is connected to a metallic or non-metallic support arrangement 26 positioned on substrate 14 (generally over an oxide or other insulator). Support arrangement 26 extends, by way of example, in a generally "C" shaped orientation, from end 20*c* to end 20*b* so as to support the bridge 16 over substrate 14, with common central bridge portion 22 being positioned over an end 30 of first conductor 12. The support arrangement 26 includes an opening 32, for a purpose to be described hereinafter.

Conductive bridge segments may be added, electrically connecting arm 18*c* with arm 18*a* via segment 34, and electrically connecting arm 18*b* with arm 18*a* via segment 35. If the support arrangement 26 is of a non-conductive material, a conductive segment 36 is added to complete the electrical connection with second conductor 13. It is to be noted that the added current path length through segment 34 or 35 is small relative to the wavelength of the microwave signal being switched.

Although a generally C-shaped support arrangement is illustrated by way of example, other arrangements are possible. For example, support segments could extend linearly between the distal ends of the arms, instead of curving. Further, the support arrangement could be comprised of individual support posts, one under each of the distal ends of the bridge arms. In the latter case, segments 34 and 35 would be eliminated.

FIG. 4 illustrates a segment of a typical prior art bridge arm 40. Bridge fabrication and/or a multilayer structure, produces stresses in the metal arm 40 and may cause the arm to curl, as indicated by the curl radius R, and thus stiffen to an objectionable degree. Controlling the internal stresses is difficult and the stiffening due to stress-induced curling can significantly increase the pull down voltage required for on/off switch operation. It may be shown that the degree of arm stiffening is directly related to the moment of inertia of the arm, and that curling increases this moment of inertia.

The present invention substantially reduces the effects of arm (and therefore, bridge) stiffening due to stress, and to this end reference is additionally made to FIG. 5 which illustrates a sectional view of a portion of arm 18*a,* exemplary of all three arms.

The arm 18*a* includes a longitudinal slot 42*a* which lies along an axis A and extends generally from the support 26 to the common central bridge portion 22. If curling of the arm occurs, the provision of slot 42*a* significantly reduces the effect of curling-induced stiffening, thus allowing for reduced pull down voltage requirements.

Curling however can not occur where the arm initially meets and is joined to the support 26, as indicated by dotted line juncture 44*a*. Since there is no stiffening due to curling, arm 18*a* is accordingly weaker at this position and can potentially exceed its elastic limit during fabrication and/or continued operation of the switch. To prevent potential permanent deformation of the arm at this juncture 44*a,* there is provided individual stiffener elements 48*a* and 49*a,* each of which straddles the juncture 44*a* on either side of axis A, thereby eliminating the weak regions.

Referring once again to FIGS. 1 to 3, end portion 30 of first conductor 12 is constructed and arranged to define an open area 56. Disposed within the open area 56 is a pull down electrode 58 of a height less than that of the end portion 30 and is electrically insulated from conductor 12. A pad 60, to which the pull down voltage is applied, is connected to the pull down electrode 58 via a thin film resistor 62 which passes through the opening 32 in support 26 and through an opening 64 in end portion 30. The resistor 62 is intended to essentially eliminate loading on the microwave signals and should be of a relatively high impedance value with respect to the 50 ohm conductor impedance. If desired, the switch may be fabricated such that resistor 62 tunnels under support 26 and end portion 30, thus eliminating openings 32 and 64.

If the switch 10 is a capacitive type MEMS switch, then a dielectric layer 66 is deposited over the end portion 30, but not over the open area 56. When a pull down voltage is applied to pull down electrode 58 there is an electrostatic attraction with the undersurface 70 of the common central bridge portion 22 drawing it down to make contact with the dielectric layer 66, acting as a mechanical stop. When contact is made, a capacitive electrical connection is made between the first and second conductors 12 and 13.

If the switch is of the ohmic type, then no dielectric layer is present and the common central bridge portion 22 makes direct ohmic contact with the end 30 to complete an ohmic electrical connection between the first and second conductors 12 and 13.

With a capacitive type MEMS switch, as illustrated by way of example in FIGS. 1 to 3, no pull down voltage is applied directly to the end 30 of first conductor 12 and accordingly, the pull down field is only between the common central bridge portion 22 and the pull down electrode 58. Thus, there can be no electrical charge build up since no dielectric is deposited over pull down electrode 58, or on the underside common area of the bridge 16. Hence, the bridge 16 will not remain deflected after removal of the pull down voltage.

Although the end 30 of first conductor 12 is illustrated as being hexagonal, any design wherein the end of the conductor encompasses the pull down electrode is contemplated, including total or substantially total envelopment. Further, in order to ensure that the common central bridge portion 22 makes uniform contact with the end 30, and does not experience any deflection, a stiffener 72 may be applied to the top surface of the common central bridge portion 22.

Typical MEMS switches are generally made utilizing conventional well-known integrated circuit fabrication techniques. During the switch fabrication process, certain solvents are used to remove unwanted material. Surface tension effects, as a result of the solvents, can force the arms 18*a,* 18*b* and 18*c* toward the substrate 14 to a degree where the elastic limit of the arms may be exceeded, thereby causing permanent deformation. To obviate this possibility, switch 10 is fabricated to include bumpers 74 positioned below respective arms 18*a,* 18*b* and 18*c* to limit downward travel of the arms during the fabrication process.

The foregoing detailed description merely illustrates the principles of the invention. It will thus be appreciated that those skilled in the art will be able to devise various arrangements which, although not explicitly described or shown herein, embody the principles of the invention and are thus within its spirit and scope.

What is claimed is:

1. A MEMS switch comprising:

a) a substrate member;

b) first and second spaced-apart RF conductors deposited on said substrate;

c) a support arrangement on said substrate;

d) a bridge member having at least three radially disposed arms of equal length, each said arm having one end connected to said support arrangement and a second end integral with a common central bridge portion having an undersurface;

e) at least one of said arms being electrically connected to said second conductor;

f) said first conductor having an end portion facing said undersurface of said central bridge portion;

g) said end portion of said first conductor being constructed and arranged to define an open area;

h) a pull down electrode disposed within said open area of, and electrically isolated from, said first conductor, and being of a height less than that of said end portion of said first conductor;

i) said central bridge portion being drawn toward said first conductor upon application of a control voltage to said pull down electrode, to present a relatively low impedance, allowing a signal to propagate between said first and second conductors.

2. A MEMS switch according to claim 1 wherein:

said bridge member (d) has three arms spaced 120° apart.

3. A MEMS switch according to claim 2 wherein:

said support arrangement (c) extends between a first and second of said arms, and between said first and a third of said arms of said bridge member (d).

4. A MEMS switch according to claim 3 and further comprising:

m) an electrical path which extends between said first and said second arms, and between said first and said third arms of said bridge member (d).

5. A MEMS switch according to claim 1 wherein:

each said arm of said bridge member (d) lies along a longitudinal axis; and, each said arm includes a slot positioned along said longitudinal axis to reduce arm curling-induced stiffness.

6. A MEMS switch according to claim 1 wherein:

each said arm of said bridge member (d) includes at least one stiffener member positioned on the arm where it connects to said support arrangement.

7. A MEMS switch according to claim 6 wherein:

each said arm of said bridge member (d) lies along a longitudinal axis; and, each said arm includes two said stiffener members, one on either side of said longitudinal axis.

8. A MEMS switch according to claim 1 and further comprising:

j) a stiffener member positioned on said common central bridge portion of said bridge member (d).

9. A MEMS switch according to claim 1 and further comprising:

k) a dielectric layer disposed on said end portion of said first conductor, of said first and second spaced-apart RF conductors (b), such that a capacitive connection is made between said first and second conductors upon application of said control voltage.

10. A MEMS switch according to claim 1 and further comprising:

l) a pad deposited on said substrate member (a) for receiving said control voltage; and m) a thin film resistor connecting said pad (l) with said pull down electrode (h).

11. A MEMS switch according to claim 1 and further comprising:

o) bumper members positioned below said arms to limit downward travel thereof so as to prevent each said arm from exceeding its elastic limit during switch fabrication.

* * * * *